United States Patent [19]

Meek et al.

[11] Patent Number: 4,553,598

[45] Date of Patent: Nov. 19, 1985

[54] FULL BORE SAMPLER VALVE APPARATUS

[75] Inventors: Dale E. Meek, Missouri City; James M. Upchurch, Stafford, both of Tex.

[73] Assignee: Schlumberger Technology Corporation, New York, N.Y.

[21] Appl. No.: 654,516

[22] Filed: Sep. 24, 1984

Related U.S. Application Data

[63] Continuation of Ser. No. 290,659, Aug. 6, 1981.

[51] Int. Cl.[4] ..... E21B 43/12; E21B 42/00

[52] U.S. Cl. ..... 166/317; 166/264; 166/321

[58] Field of Search ..... 166/131, 142, 145, 148, 166/150, 151, 152, 264, 317, 319, 321, 323, 331, 332, 334

[56] References Cited

U.S. PATENT DOCUMENTS

| | | | |
|---|---|---|---|
| 3,071,193 | 1/1963 | Raulins | 166/332 |
| 3,308,887 | 3/1967 | Nutter | 166/150 |
| 3,388,745 | 6/1968 | Cole | 166/152 |
| 3,856,085 | 12/1974 | Holden et al. | 166/324 |
| 4,063,593 | 12/1977 | Jessup | 166/317 |
| 4,125,165 | 11/1978 | Helmus | 166/323 |
| 4,144,937 | 3/1979 | Jackson et al. | 166/332 |
| 4,270,610 | 6/1981 | Barrington | 166/317 |
| 4,286,662 | 9/1981 | Page, Jr. | 166/317 |

FOREIGN PATENT DOCUMENTS

| | | | |
|---|---|---|---|
| 2025486 | 1/1980 | United Kingdom | 166/334 |

*Primary Examiner*—Stephen J. Novosad
*Assistant Examiner*—William P. Neuder

[57] ABSTRACT

In accordance with an illustrative embodiment of the present invention, a full-bore sampler and safety valve apparatus includes a housing having an actuator mandrel slidably arranged therein, axially spaced normally open ball valve elements mounted on the mandrel assembly and cooperable with fixed eccentric pins on the housing for simultaneously closing a flow passage extending through the housing when the mandrel assembly is shifted from one axial position to another, a hydraulically operable piston on the mandrel assembly normally subject to balanced pressures, and means responsive to a predetermined pressure of fluids in the well annulus for exposing the hydraulically operable means to well pressure to cause shifting of the actuator mandrel assembly and simultaneous closing of the ball valve elements.

13 Claims, 8 Drawing Figures

FULL BORE SAMPLER VALVE APPARATUS

This application is a continuation of application Ser. No. 290,659, filed Aug. 6, 1981.

FIELD OF THE INVENTION

This invention relates generally to drill stem testing tools, and particularly to a new and improved full bore sampler and safety valve apparatus for trapping a flowing sample of formation fluids that may be produced from an isolated well interval.

BACKGROUND OF THE INVENTION

A drill stem test may be considered to be a temporary completion of an earth formation that has been intersected by a well bore. A packer is run into the well on a pipe string and is set to isolate the interval of the well bore to be tested, and then a test valve is opened to permit fluids in the formation to flow into the borehole and up into the pipe string to obtain an indication of the commercial potential of the well. Pressure data is recorded with the test interval open and then shut in, from which many useful parameters such as permeability and initial reservoir pressure can be determined. It also is desirable to collect an actual sample of the fluids for subsequent laboratory analysis.

A sampler that has been used for many years with great success is disclosed in Nutter U.S. Pat. No. 3,308,887, assigned to the assignee of this invention. As shown in FIG. 3B of that patent, the flow of formation fluid is routed through an annular chamber having sleeve valves at each end that can be simultaneously opened or closed. When the valves finally are closed at the end of the test, a flowing sample of the fluid being produced is entrapped at formation conditions of temperature and pressure. However, the testing apparatus shown in the Nutter patent has a barrier that blocks vertical access through the tool and which must be removed before other equipment such as a pressure recorder or a perforator can be run into the well.

A sampler valve that uses a pair of vertically spaced ball valves to simultaneously open and close the respective ends of a sample chamber is shown in U.S. Pat. No. 4,063,593. The device shown in the '593 patent, while being full-bore, is considered to be unduly complicated and thus subject to malfunction in use in the well.

It is the general object of the present invention to provide a new and improved full-bore sampler valve for trapping the last flowing sample of formation fluids that are produced during a drill stem test.

Another object of the present invention is to provide a new and improved full-bore sampler apparatus that can be closed responsive to a specific annulus pressure signal to trap a sample and to also function as a safety valve when closed to shut in the formation being tested.

SUMMARY OF THE INVENTION

These and other objects are attained in accordance with the concepts of the present invention through the provision of a sampler valve apparatus comprising a housing having an axially shiftable actuator mandrel that carries spaced ball valve elements that when open present an unobstructed vertical passage and when closed block the open ends of a sample chamber for containing a discrete volume of formation fluids. The actuator mandrel carries a piston that is sealingly slidable within a cylinder formed on the housing, with opposite sides of the piston initially being subject to atmospheric or other low but equal pressures. In response to a predetermined increase in the pressure of fluids in the well annulus outside the housing, a passageway leading to one side of the piston is opened so that well fluids at hydrostatic pressure can act on one side of the piston to force the actuator mandrel to shift axially of the housing and to cause the ball valves to be rotated simultaneously to their closed positions. In accordance with another feature of the present invention, the axial movement of the actuator mandrel can be employed to open a valve that functions to communicate the well annulus with an associated valve such as a reverse circulating valve to enable the same to be operated by subsequent changes in the pressures of fluids in the well annulus.

BRIEF DESCRIPTION OF THE DRAWINGS

The present invention has other objects, features and advantages that will become more clearly apparent in connection with the following detailed description of a preferred embodiment, taken in conjunction with the appended drawings in which.

DESCRIPTION OF A PREFERRED EMBODIMENT

Figure 1:
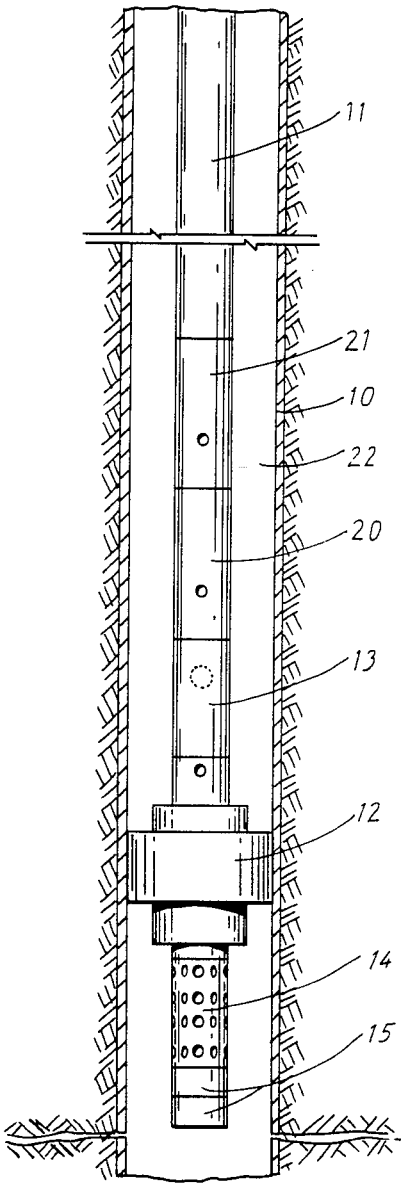
FIG. 1 is a schematic view of a string of drill stem testing tools positioned in a well being tested.

Referring initially to FIG. 1, there is shown schematically a string of drill stem testing tools suspended within the well casing 10 on drill pipe 11. The tools comprise a hook wall-type packer 12 that functions to isolate the well interval to be tested from the hydrostatic head of fluids thereabove, and a main test valve assembly 13 that functions to permit or terminate the flow of formation fluids from the isolated interval. The test valve 13 preferably is of a type that may be opened and closed in response to changes in the pressures of fluids in the annulus 22 between the pipe 11 and the casing 10. The valve assembly 13 is well known and is covered by U.S. Pat. No. Re. 29,638 also assigned to the assignee of the present invention. The disclosure of U.S. Pat. No. Re. 29,638 is incorporated herein by reference. Other equipment components such as a jar and a safety joint may be employed in the string of tools but are not illustrated in the drawings. A perforated tail pipe 14 may be connected to the lower end of the mandrel of the packer 12 to enable fluids in the well bore to enter the tools, and typical pressure recorders 15 are provided for the acquisition of pressure data during the test.

Figure 2A:
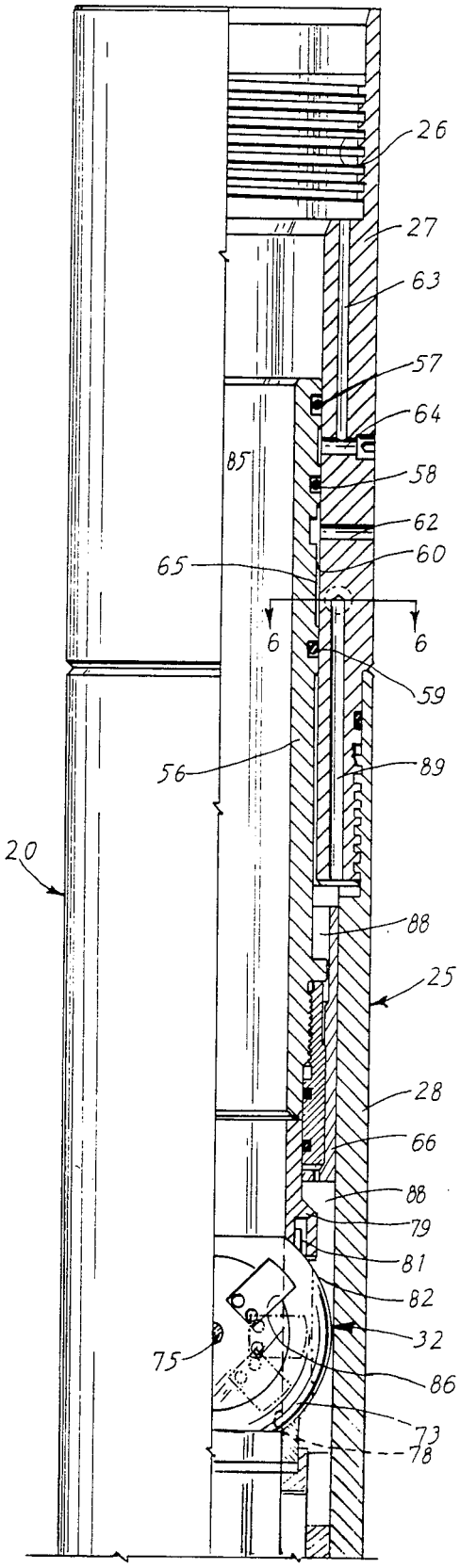
FIGS. 2A–2C are longitudinal sectional views, with portions in side elavation, of a full-bore sampler and safety valve constructed in accordance with the principles of the present invention.

A full-bore sampler safety valve 20 that is constructed in accordance with the principles of the present invention is connected in the pipe string just above the main test valve assembly 13. As shown in detail in FIGS. 2A–2C the valve assembly 20 includes a tubular housing 25 that has threads 26 at each end for connecting the same within the tool string. The housing 25 may include several sections that are threaded together such as an upper sub 27, a sampler sub 28, a cylinder sub 29 and a lower sub 30. Upper and lower vertically spaced ball valve assemblies 32 and 33 are rotatably mounted on an elongated actuator mandrel 34 that is axially slidable within the housing 25 between a lower position as shown in the drawings where the ball valves are open, and an upper position where the valves simultaneously are rotated closed. When the valves 32 and 33 are closed, the region 35 therebetween and areas outside the mandrel provide a sample chamber for entrapping a discrete volume of formation fluid.

Figure 2B:
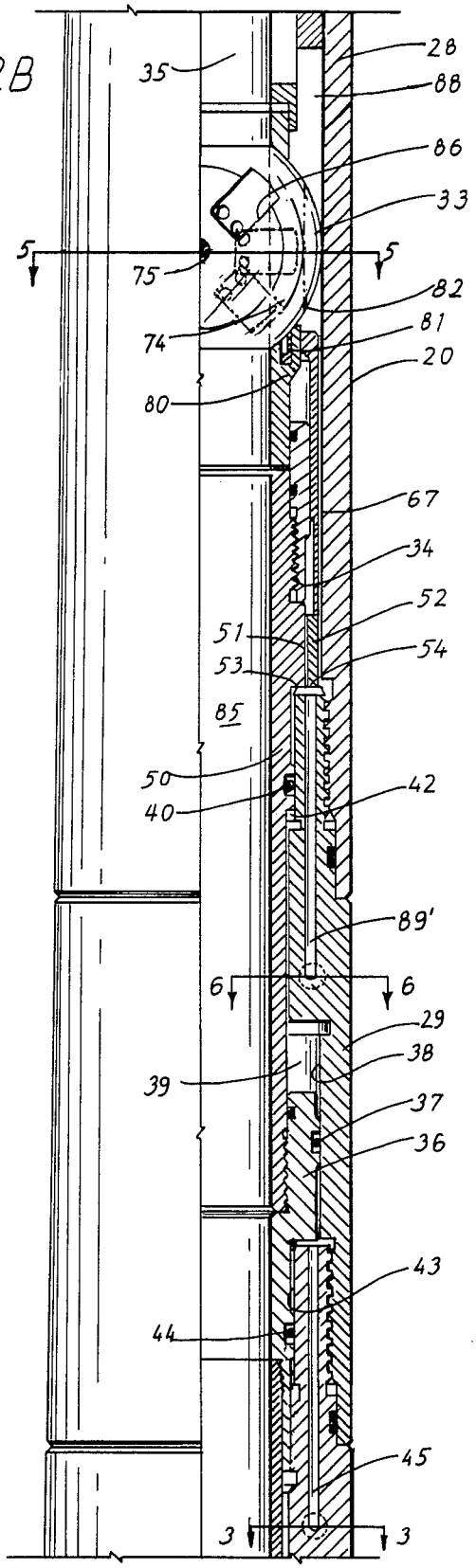
Figure 2C:
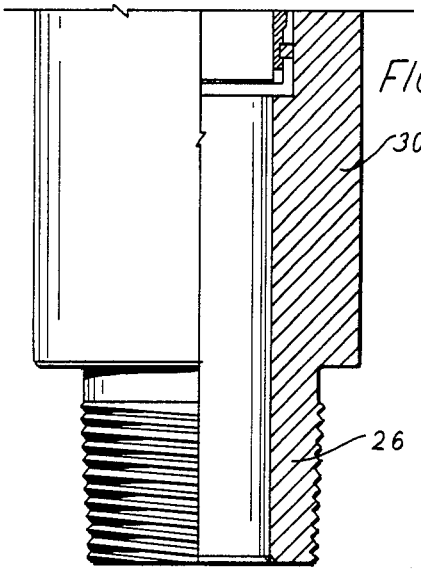
Figure 4:
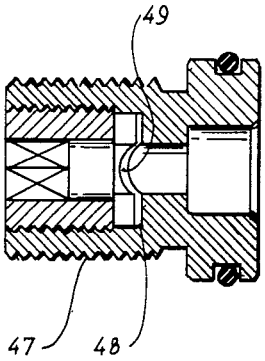
FIG. 4 is an enlarged sectional view of the rupture disc assembly.
Figure 3:
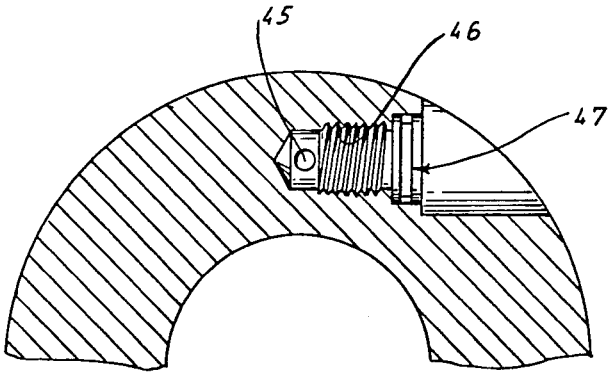
FIG. 3 is a fragmentary cross-section view taken along line 3—3 of FIG. 2B.

As shown in FIG. 2B, the lower section of the mandrel assembly is provided with a piston 36 which carries a seal 37 that engages the wall 38 of an annular recess 39 formed in the cylinder section 29 of the housing 25. The mandrel assembly 34 also carries seals 40 and 44 that engage housing wall surfaces 42 and 43 above and below the recess 39, with the surfaces 42 and 43 being formed on the same diameter. Initially, the regions above and below the piston 36 contain air at atmospheric pressure. The lower region is in communication with a pressure channel 45 that terminates in an outwardly directed threaded port 46 (FIG. 3) which normally is closed by a rupture disk assembly 47 shown in FIG. 4. As will be recognized by those skilled in the art, the rupture disk 48 will remain intact until a predetermined pressure is applied thereto which causes the central portion 49 of the disk to fail and thereby admit annulus fluids under pressure into the region below the piston 36.

The tubular section 50 of the mandrel assembly 34 that carries the seal 40 is provided with an outwardly extending flange 51 which initially is located underneath a split lock ring 52 to hold the same in its expanded condition. Upward movement of the mandrel assembly 34 will move the flange 51 out from underneath the split lock ring 52 and enable the ring to resile inwardly to its retracted condition where it is positioned between the downwardly facing shoulder 53 on the lower end of the flange 51 and an upwardly facing shoulder 54 that is formed on the upper end of the cylinder section 29 of the housing 25. In the retracted position, the lock ring 52 prevents downward movement of the mandrel assembly 34 with respect to the housing 25.

The upper end section 56 of the mandrel assembly 34, as shown in FIG. 2A, is provided with three vertically spaced seal rings 57, 58, 59 that engage the inner wall surface 60 of the upper housing sub 27. A port 62 extends laterally through the wall of the sub 27 and a companion pressure channel 63 extends from a lateral opening 64 upwardly through the housing wall where the channel may be communicated with the pressure operated piston or the like in an associated pressure controlled well tool 21 (FIG. 1) such as a reversing valve. The upper and middle seal rings 57, 58 normally are positioned respectively above and below the port 64 as shown to block off the same, whereas the middle and lower seal rings 58, 59 normally are located respectively above and below the port 62 to blank it off to fluid flow. When the mandrel assembly 34 is shifted upward as previously described, the middle seal 58 moves above the port 64 to a position where the annular clearance space 65 communicates the two ports 62 and 64 with one another to enable well annulus pressure, and changes in such pressure, to be applied to the associated well tool 21 for the purpose of operating or controlling the same.

Figure 5:
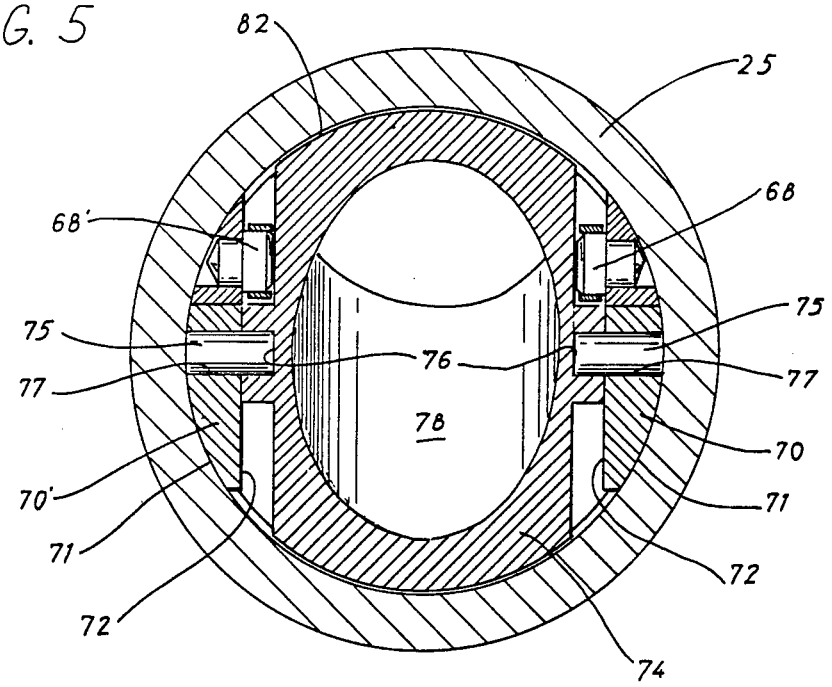
FIG. 5 is a cross section taken along line 5—5 of FIG. 2B, with all the ball valve element rotated to the intermediate dot-dash line position.

Upper and lower sleeves 66, 67 that are fixedly mounted within the housing section 28 carry eccentric pins 68, 68′ that are laterally offset from the center line of the housing as shown in FIG. 5. The mandrel assembly 34 in its central region includes arms 70 and 70′ to either side which have circular outer walls 71 and flat inner walls 72. Upper and lower ball valve elements 73 and 74 are rotatably mounted on the arms 70 and 70′ by diametrically opposed trunnion pins 75 that fit in holes 76 formed in the flat side walls of the ball elements 73, 74 and extend into apertures 77 formed in the arms 70 and 70′. Each ball valve element has a bore 78 that when aligned with the housing axis presents an unobstructed vertical passage through the tool. Upper and lower valve seat rings 79, 80 carry seals 81 that slidably engage the spherical outer peripheries 82 of the respective ball valve elements to close off the central flow passage to fluid flow when the valves are rotated through an angle of 90° with respect to the orientation shown in FIGS. 2A and 2B.

Figure 6:
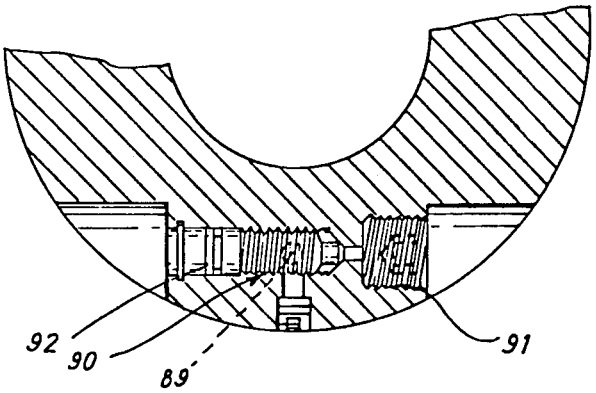
FIG. 6 is a fragmentary cross-sectional view taken along lines 6—6 of FIGS. 2A and 2B.

Each of the ball valve elements 73, 74 has radially extending cam slots 86 formed in the opposite side walls thereof which are engaged by the eccentric pins 68, 68′. Thus arranged, upward shifting of the ball valve elements with the mandrel assembly 34 causes the elements to be rotated simultaneously to their closed positions with respect to the seat rings 79 and 80, and downward shifting causes the elements to simultaneously rotate open. When closed, the region 35 between the ball valve elements 73, 74 and the annular open areas outside the mandrel from the seal 59 down to the seal 40 provide a chamber for trapping a flowing sample of formation fluids. The annular space 88 located between the mandrel assembly 34 and the inner wall of the housing section 28 above the upper ball valve element 73 is communicated by a vertical port 89 to a typical drain plug assembly 90 shown in FIG. 6 that enables the sample of formation fluids trapped in the chamber to be removed when the tool has been removed from the well. An identical drain plug assembly 90′ may be located in the wall of the cylinder section 29 at the lower end of a vertical port 89′.

OPERATION

In operation, the sampler-safety valve apparatus 20 assembled as shown in the drawings is incorporated into the string of drill stem testing tools above the main test valve 13, and the string is run into the well on the pipe string 11. During running of the tools and operation of the test valve 13, the ball valve elements 73 and 74 are in their open positions shown in FIGS. 2A and 2B. The enclosed regions above and below the piston 36 initially contain an atmospheric pressure, so that the mandrel assembly 34 is completely balanced with respect to pressure.

The rupture disk 48 is selected to have a burst pressure rating such that it will remain intact during all of the annulus pressure changes that are employed to operate the main test valve 13. However, when it is desired to terminate the test and obtain a sample, a pressure increase in excess of that employed to activate the test valve 13 is applied at the surface to the well annulus 22. Such pressure increase ruptures the central region 49 of the disk 48 to admit annulus fluid via the port 46 and channel 45 into the region below the piston 36 on the mandrel assembly 34. Upward force on the piston 36 due to such pressure will shift the mandrel assembly 34 upwardly within the housing 25, causing both of the valve elements 73, 74 to be rotated simultaneously to their closed positions to trap a sample of formation fluids in the chamber 35. This rotation is indicated in FIGS. 2A–2B as movement from the open position shown in solid lines, through an intermediate position shown in dot-dash lines, to the closed position shown in dot-dot-dash lines. The lock ring 52 flexes inwardly underneath the shoulder 53 on the mandrel to lock the sampler closed. The port 62 in the upper section 27 of the housing 25 is communicated with the vertical channel 63 via the clearance space 64 to enable operation of associated equipment in response to subsequent changes in the well annulus pressure.

When the tool string has been removed from the well, the sample trapped in the chamber 35 and in the annular areas 88 outside the mandrel assembly can be removed by hooking up a drain line to the threaded port 91 (FIG. 6) and then opening the plug valve 92.

The apparatus of the present invention also functions as a safety valve because the throughbore of the tool string can be closed at any time in response to the specific pressure signal required to actuate the sampler valves. It also will be recognized that the ball valves 73 and 74 have the capability of cutting a wireline that may be extending therethrough where the valves must be closed quickly in the event of an emergency, or where a wireline tool has become hung in the tool string below the sampler.

It will now be apparent that a new and improved full bore sampler-safety valve apparatus has been disclosed. Since certain changes or modifications may be made by those skilled in the art without departing from the inventive concepts involved, it is the aim of the appended claims to cover all such changes and modifications falling within the true spirit and scope of the present invention.

What is claimed is:

1. Apparatus adapted for use in closing the bore of a pipe string during a well testing operation comprising: a housing having an actuator mandrel assembly slidably disposed therein, said housing and mandrel assembly defining a passage for the flow of formation fluid in a direction therethrough; axially spaced full-opening valve means mounted on said mandrel assembly for opening said flow passage in one longitudinal position of said mandrel assembly within said housing and for closing said flow passage in another longitudinal position therein; hydraulically operable means on said mandrel assembly for shifting said mandrel assembly from said one position to said other position, said hydraulically operable means being normally subject to balanced atmospheric or other low pressures and normally not subject to the pressure of fluids in the well annulus surrounding said housing; and means responsive to a predetermined well annulus pressure for subjecting said hydraulically operable means to well annulus pressure to cause shifting of said mandrel assembly in the direction of the flow of said formation fluid to said other position and closure of said flow passage by said valve means, a region of said flow passage located between said valve means defining a sample chamber adapted to trap a flowing sample of formation fluids.

2. The apparatus of claim 1 wherein said valve means comprise ball valve elements rotatably mounted on said mandrel assembly and cooperable with eccentric means fixed with respect to said housing, said ball valve elements each being sealingly engaged with seat means surrounding said flow passage and included in said mandrel assembly.

3. The apparatus of claim 2 wherein said hydraulically operable means includes piston means on said mandrel assembly sealingly slidable within cylinder means in said housing; and seal means between said housing and mandrel assembly located on opposite sides of said piston means, said seal means being engaged on substantially the same seal diameter and defining the ends of enclosed chambers located on opposite sides of said piston means, each of said chambers initially containing a fluid such as air at substantially the same pressure.

4. The apparatus of claim 3 wherein said subjecting means comprises port means in said housing leading from the exterior thereof to one of said chambers, and means including a rupture disc for closing said port means, said rupture disc having a central region that is designed to fail when a predetermined fluid pressure is applied thereto.

5. The apparatus of claim 1 wherein said subjecting means comprises port means leading from the well annulus to said hydraulically operable means, and means including a rupture disc for closing said port means, said rupture disc having a central region that is designed to fail when a predetermined fluid pressure is applied thereto.

6. The apparatus of claim 1 further including means for locking said mandrel assembly in said other position to retain said valve means in said closed position.

7. The apparatus of claim 6 wherein said locking means includes detent means movable from an expanded to a contracted condition, means holding said detent means in expanded condition when said mandrel assembly is in said one position, recess means on said mandrel assembly for enabling movement of said detent means to its contracted condition when said mandrel assembly slides to said other position, and oppositely facing shoulder surfaces on said mandrel assembly and said housing engageable with said detent means when the same is in its contracted condition.

8. The apparatus of claim 1 further including additional normally closed valve means in said housing for communicating the exterior of said housing with an interior region thereof in response to axial sliding of said mandrel assembly from said one position to said other position.

9. The apparatus of claim 8 wherein said additional valve means comprises axially spaced port means in said housing, one of said port means extending through the wall of said housing, and sleeve means carrying seal elements that are arranged to prevent fluid communication between said port means when said mandrel assembly is in said one position and to permit fluid communication when said mandrel assembly slides to said other position.

10. The apparatus of claim 9 wherein said sleeve means constitutes an end section of said mandrel assembly.

11. Valve apparatus adapted for use in a well testing operation to close the bore of a pipe string and to trap a sample of formation fluids in response to the application of a predetermined pressure to fluids standing in the well annulus, comprising: a housing having means at its ends for connecting the same in the pipe string; an actuator mandrel assembly slidably disposed in said housing, said assembly and housing defining a passage for the upward flow of formation fluids therethrough; upper and lower ball valve elements rotatably mounted on said mandrel assembly for providing a full-opening bore through said apparatus when said mandrel assembly is in a lower position within said housing and for simultaneously closing said flow passage when said mandrel assembly is shifted to an upper position within said housing, said valve elements when closed defining walls of a sampler chamber that is located in part in the bore of said mandrel assembly between said valve elements; cylinder means in said housing; piston means on said mandrel assembly sealingly engaging said cylinder means; seal means on said housing and mandrel assembly above and below said piston means and having substantially the same diameter of sealing engagement to provide variable capacity chambers, normally both subjected to atmospheric or other low pressures and normally not subject to well annulus pressure, located above and below said piston means; port means leading from the lower one of said variable capacity chambers to the exterior of said housing; and rupture disc means normally closing said port means and responsive to a predetermined pressure differential for admitting well annulus fluids into said lower variable capacity chamber whereby the pressure of said fluids can act on the lower face of said piston means to shift said mandrel assembly upwardly to said upper position and cause closure of said ball valve elements.

12. The apparatus of claim 11 further including expansible and contractable detent means for locking said mandrel assembly in said upper position to correspondingly lock said ball valve elements in their closed positions.

13. The apparatus of claim 11 further including additional normally closed valve means on said mandrel assembly and said housing for providing selective fluid communication between the well annulus and an associated pressure controlled well tool.

* * * * *